United States Patent [19]

Gallis

[11] 4,401,291

[45] Aug. 30, 1983

[54] CONCRETE WALL FORM WITH SAFETY ATTACHMENT

[75] Inventor: Anthony J. Gallis, Lake Hiawatha, N.J.

[73] Assignee: Harsco Corporation, Camp Hill, Pa.

[21] Appl. No.: 231,492

[22] Filed: Feb. 4, 1981

[51] Int. Cl.[3] ..... E04G 11/00; E04G 17/04

[52] U.S. Cl. ..... 249/196; 249/218; 249/219 R

[58] Field of Search ..... 249/205, 211, 216, 218, 249/219 R, 189, 190–192, 196, 213, 217, 18, 25, 26, 33, 44; 24/243 R, 260, 263 SW; 403/49, 324

[56] References Cited

U.S. PATENT DOCUMENTS

| | | | |
|---|---|---|---|
| 2,017,553 | 10/1935 | Troiel | 249/47 |
| 3,374,984 | 3/1968 | Mueller | 249/216 |
| 3,512,356 | 5/1970 | Krekeler | 59/84 |
| 3,661,354 | 5/1972 | Dagiel et al. | 249/192 |
| 4,210,306 | 7/1980 | Schimmel | 249/192 |
| 4,228,986 | 10/1980 | Schimmel et al. | 249/192 |

FOREIGN PATENT DOCUMENTS

| | | | |
|---|---|---|---|
| 941597 | 4/1956 | Fed. Rep. of Germany | 59/84 |
| 559308 | 2/1975 | Switzerland | 249/192 |

*Primary Examiner*—Willard E. Hoag

*Attorney, Agent, or Firm*—Curtis, Morris & Safford

[57] ABSTRACT

A concrete wall form with an attachment inserted between extending abutting flanges of form panels to secure a workman's safety belt, the attachment being pivotally mounted and comprising an oval plate having two spaced circular holes.

7 Claims, 3 Drawing Figures

CONCRETE WALL FORM WITH SAFETY ATTACHMENT

FIELD OF THE INVENTION

This invention relates generally to wallform systems for use in fabricating concrete walls, and particularly to apparatus for securing a worker's safety belt hook typically to modularized prefabricated wallform equipment.

BRIEF DESCRIPTION OF THE PRIOR ART

Forms for fabricating a poured-concrete wall generally comprise a pair of opposed panels rigidly buttressed by a support structure, which includes preferably-horizontal studs or joists, reinforced by walers which are arranged perpendicularly thereto. The opposed panels function as a mold for the wet concrete as it is poured and are removed after it has set. Originally, and even today (usually on smaller jobs), wallforms consisted of plywood panels with a wooden support structure, custom-built at the site and then demolished after the concrete had been poured.

This inefficient and costly process has largely been superseded by reusable, mobile wallform systems, including the prefabricated Mod-U-Form System ® manufactured by the assignee of the present invention. This system comprises modular panels, in standard sizes, consisting of a panel of a facing material such as plywood braced with a steel frame. The panels can either be assembled at the construction site into a form of the desired shape, or assembled at a remote location and moved to the site as a gang. Such gangs can be reused in successive concrete pours on a given project, leading to considerable economies of labor and materials.

Wallform panels are frequently assembled into gangs of considerable size.The forms can also "climb" as a wall is formed with successive pours, each at a greater vertical height. When it becomes necessary for workmen to work at a high level, there is a need for a means for securing safety belts to the wallforms to guard against injury.

It is desirable that such a device be simple in design and make use of the preexisting hardware and other features of the Mod-U-Form type system, for reasons of economy, and that it be simple in use, for reasons of safety.

The wallform panels of this type system possess features that are useful for this purpose. First, they are designed to be held together edge-to-edge by standard wedge-bolts inserted through matching slots in the outer portions of the frames of adjacent panels. After assembly, a certain number of vacant pairs of wedge-bolt slots that have not been used for connecting adjacent panels are available for attaching other hardware.

Also, when opposed gangs of panels are placed in position to receive poured concrete, tie rods are secured between the opposed gangs in order to hold them rigidly in position and resist the pressure of the wet concrete. The ends of tie rods are inserted into voids or holes formed between the abutting side rails of adjacent ganged forms. These holes are formed by a series of scarfs or routs in outwardly facing lips of the siderails of the individual frames at the rearmost and outermost edge, which align with corresponding scarfs on adjacent frames.

Corresponding wedge bolt slots aligning with the scarfs are used to secure the looped or slotted ends of the tie rods. Again, after assembly of wallform gangs and their connection with tie rods, a certain number of vacant tie rod holes and corresponding wedge-bolt slots will be available for securing other hardware.

Examples of earlier designs for securing a worker's safety belt to such wedge-bolt slots and tie rod holes include U.S. Pat. Nos. 4,210,306 and 4,228,986 (which are incorporated herein by reference). The former discloses a "safety key" shaped generally like a conventional key and having a shank width approximating that of a wedge bolt. This key can be inserted into either a vacant narrow tie-rod opening or a vacant pair of aligned wedge-bolt slots, and secured therein with wedge-bolts (in the same manner that a tie rod would be secured). The safety belt is hooked to a hole in the "head" portion of the "key."

U.S. Pat. No. 4,228,986 discloses another such apparatus modified to overcome torque problems inherent in the earlier design. This modified design has a flat portion adapted to be positioned along one side of and parallel to a pair of adjacent siderails; with overhanging ears intended to counteract the torque problem. A slot in the flat portion is aligned with a pair of corresponding wedge-bolt slots, and standard wedge-bolts are used to secure the apparatus.

These two devices have several disadvantages. In the first, when the key is subjected to a substantial downward pull, the lower split edge forming the tie-rod hole and the shank portion of the key resting on that edge are subjected to a severe stress (the key not being free to move below the horizontal). Additionally, competitive modular wallform systems have tie-rod holes of different sizes; so that if the safety key is inserted into a hole which is larger than one for which it was designed, then the key may well be subjected to a torsional stress beyond its designed capacity.

U.S. Pat. No. 4,228,986 attempts to remedy some of these defects, but also has major disadvantages. Extending beyond the siderail from the above-mentioned flat portion of the device is a projecting portion containing a hole to which the safety belt is to be attached. Upper and lower ear portions extending from the projecting portion are intended to rest closely on the edge of the siderail and resist any rotation and torsional stress on the flat portion or on the securing wedge-bolt.

The disadvantages of the latter device lie, first, in manufacture, and second, in use. Tolerances must be adhered to very closely, if the ears are to rest properly on the edge of the siderail, so that manufacture is difficult and the devices can be used with only one type of frame. In addition, bending operations and, in one embodiment, welding operations are required, making manufacture expensive. Finally, the odd shape of the device complicates storage.

Accordingly, the object of the present invention is to provide a simple attachment for holding a safety belt onto a wallform assembly that is inexpensive to manufacture and is both easy and safe to use.

A further object is to provide a safety attachment for a wallform assembly system that does not exert excessive torsional stresses on either the attachment itself or on cooperating wedge-bolts when it is subjected to a substantial downward force, and thus be safe to use on most known modular wallforms that it fits.

The preferred embodiment of the present invention achieves these objects by providing a generally elliptical steel plate which is to be inserted into a tie-rod hole. Formed in the plate are two circular holes, one of which is used to secure the attachment in the tie-rod hole by means of a wedge-bolt inserted through the corresponding wedge-bolt slots. The other hole is used for attaching the hook on a worker's safety belt.

The attachment plate is preferably designed to be slightly thinner and substantially narrower than the tie-rod holes in which it is used. Thus it is free to rotate in a vertical plane about the typically horizontal wedge-bolt by which it is secured, thereby reducing the problem of extreme stress on the lower edge of the tie-rod hole. Also, because the holes are circular, such rotation avoids torsional stress relative to the securing wedge-bolt, reducing the risk of failure of the parts.

In this specification and the accompanying drawings, I have shown and described a preferred embodiment of my invention and have suggested various alternatives and modifications thereof, but it is to be understood that these are not intended to be exhaustive and that many other changes and modifications can be made within the scope of the invention. These suggestions herein are selected and included only for purposes of illustration in order that others skilled in the art will more fully understand the invention and the principles thereof and will thus be enabled to modify it and embody it in a variety of forms, each as may be best suited to the conditions of a particular use.

DETAILED DESCRIPTION

Figure 1:
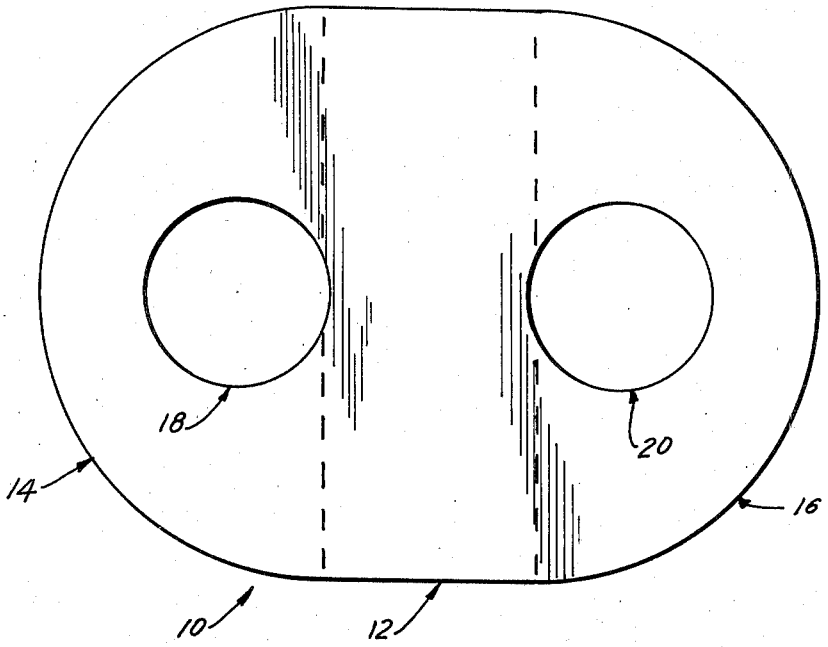
FIG. 1 is a plan view of one face of a preferred embodiment of the safety attachment according to the present invention.

In the embodiment shown in FIG. 1, the safety attachment is a generally elliptical flat metal plate 10. For simplicity in design and manufacture, it is advantageously constructed with a rectangular central area 12, a semicircular first end area 14, and a semicircular second end area 16. The diameters of areas 14 and 16 are seen to be equal to the width of area 12. In FIG. 1, areas 12, 14, and 16 are separated by dotted lines, but as manufactured, the attachment will be typically formed as an integral unit in one operation.

Symmetrically located along the longitudinal axis of plate 10 are a first hole 18 and a second hole 20, which are preferably circular and of equal size. The centers of holes 18 and 20 are located within end areas 14 and 16, respectively, and said holes are of such location and size that they will accomodate either a standard wedge-bolt or the hook of a standard safety belt.

Figure 2:
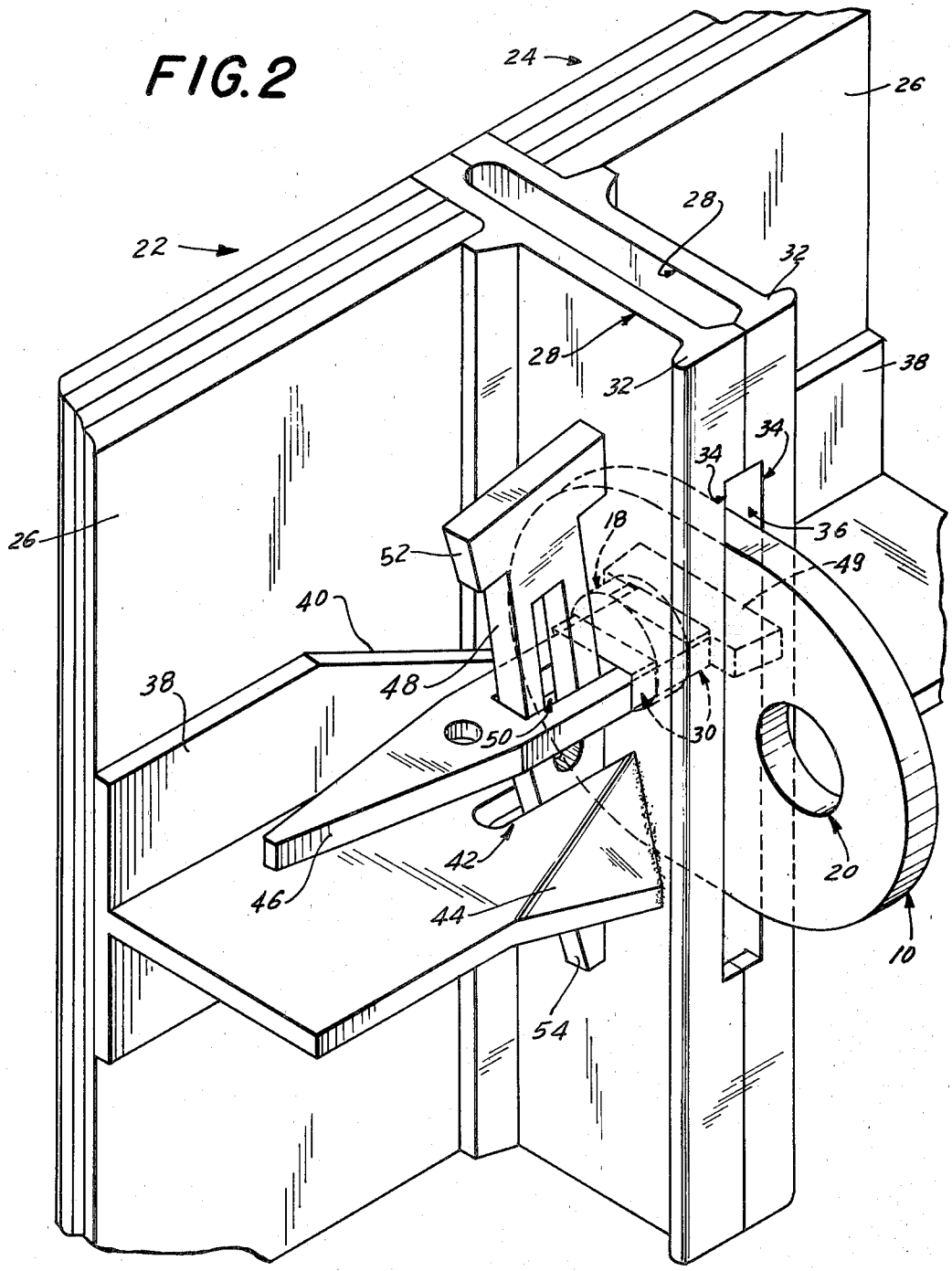
FIG. 2 is an isometric view of a portion of a wallform system with the safety attachment of FIG. 1 mounted thereon.

FIG. 2 shows a detail of a first wallform panel 22 and a second wallform panel 24 in normal cooperating relationship with each other and with safety attachment 10. Each of said wallform panels comprises a facing 26, preferably made of plywood, which, together with the facing on the other such panel, composes the surface against which concrete is poured and hardened into a desired shape. A marginal supporting frame borders and contains said facing, aiding in the handling of said panels and providing means for linking panels together and attaching additional hardware. A detail of a portion of said frame, a vertical siderail 28, is shown in FIG. 2.

Each of said siderails is seen to have formed therein at least one wedge-bolt slot 30 and an outer longitudinal rib 32. In rib 32 is formed at least one scarf 34, which is a notch routed out of said rib and which opens outwardly, away from said facing. Scarfs 34 and wedge-bolt slots 30 of adjacent siderails are disposed in registration with one another, and said scarfs cooperate to define a void 36, which is normally used to receive the end of a tie-rod (not shown).

Also shown in FIG. 2 is a T-shaped horizontal bracket member 38, which serves as additional bracing for facing 26. Formed in member 38 are a cutout 40 and a slot 42. The portion 44 of member 38 adjacent to slot 42 on the side away from facing 26 has been bent downward, away from wedge-bolt slot 30, and welded to siderail 28.

Panels 22 and 24 are shown to be fastened together by a first wedge-bolt 46 secured in place by a second wedge-bolt 48. Wedge-bolt 46 is inserted into the corresponding wedge-bolt slots 30 of the two panels, in a direction from panel 24 to panel 22, and its head 49 (visible in dotted outline in FIG. 2) is placed directly against the inner surface of the siderail 28 of panel 24. Second wedge-bolt 48 is then inserted in a slot 50 in the shank of wedge-bolt 46 with its head 52 and point 54 disposed firmly against the inner surface of siderail 28 of panel 22. Thus, wedge-bolt 46 is secured in said pair of slots 30, firmly attaching said panels 22 and 24 to one another. Note that clearance for the point of second wedge-bolt 48 is provided by slot 42.

When used, the first end 14 of attachment 10 is inserted into void 36, and hole 18 is aligned with the pair of slots 30. Then a wedge-bolt 46 is inserted through the slots 30 and hole 18 (and secured by the other wedge-bolt 48 in the usual fashion). Hole 20, which extends beyond siderail 28, is then available to receive the hook of a safety belt (not shown).

As seen in FIG. 2, the width of attachment 10 along its short axis preferably is significantly smaller than the longest dimension of void 36. Thus the attachment is free to rotate to an extent about wedge-bolt 46, in reaction to an upward or downward force applied at the second hole 20. Hole 20 is spaced from hole 18 in the illustrated preferred embodiment by an amount adapted to position the hole 20 just beyond the siderails 28 when the attachment 10 is rotated either to the top or the bottom of the void 36.

Figure 3:
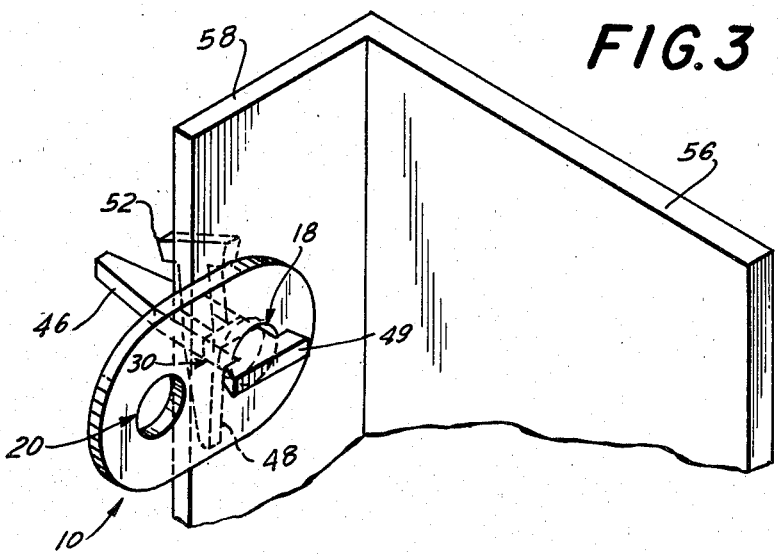
FIG. 3 is an isometric view showing an alternative use of the safety attachment.

FIG. 3 shows an alternative of the present invention. A simplified wallform panel or similar structure is shown schematically, comprising a wall 56 and a support 58. Rather than being inserted into a void between two siderails, as in the preferred embodiment, here attachment 10 has been located on the inside surface of support 58. As before, first hole 18 is aligned with wedge-bolt slot 30 in support 58. A wedge-bolt 46 is inserted which is secured with a second wedge-bolt 48, thus securing attachment 10. A hook on a safety belt (not shown) can then be inserted into hole 20. It is seen that this embodiment provides advantageous means for attaching a safety belt to a wallform or other structure when no tie-rod void of appropriate size is available. With head 49 bearing directly on attachment 10, it does not as freely rotate in the vertical plane, but will do so in reaction to sufficient force and thus will minimize any torsional forces on the wedge bolt 46 as used in FIG. 3.

Finally, in the broader aspects of this invention, several modifications can be made from the preferred embodiment described above. Several such modifications are described below. The operation of the safety attachment in other than a vertical plane is possible. Referring to FIG. 3, support 58 could be almost any structure, such as the bottom rail of a wallform panel. The thickness and hardness of the steel constituting attachment 10 is selected to be sufficient to resist failure in the event of a sharp substantial force downwardly or outwardly. Thicknesses up to $\frac{3}{8}$ inch can be used and still not exceed that which can be accommodated in a standard safety-belt hook.

The holes 18 and 20 may be non-circular and/or of different sizes and shapes, so long as the shape chosen for the first hole 18 gives relief from direct torque on the securing wedge-bolt, and the other hole 20 can readily accommodate a safety hook therein. Similarly, the spacing of the holes 18, 20, respectively, from the edge of the attachment 10 is long enough to give adequate strength (and also necessary clearances in the intended environment). The spacing of holes 18, 20 from each other is minimally enough to insure sufficient clearance from or beyond the support structure to permit the safety hook to be applied without bending in operative positions of said attachment; and maximally not so far apart as to give excessive unsupported bending leverage. Thus, for example in FIG. 2, the hole 20, secured in the void 36 by wedge-bolt 46, should be spaced from hole 18 such that said hole 18 preferably is closely adjacent to void 36, but not within it.

By "wedge bolt" is meant a flat-sided connector of the type specifically illustrated and described in the aforementioned U.S. Pat. Nos. 4,210,306 and 4,228,986 and further includes similar bolts having at least one flat side (which fit in a standard wedge bolt slot without rotation) such as short bolts, base tie bolts, long bolts, short wedges, and threaded flat bolts of the type illustrated and described in U.S. Pat. No. 4,030,694 (therein identified as a "transition bolt").

What is claimed is:

1. A concrete wall form assembly with an attachment for anchoring the hook element of a worker's safety belt to said assembly comprising a plurality of panels arranged edge to edge, each panel comprising an inner facing from which there projects outwardly a marginal supporting frame including vertical and horizontal siderails, said siderails having inner and outer side surfaces, the siderails of at least one pair of adjacent panels being arranged contiguously and having formed at correspondingly spaced intervals therealong a plurality of respectively aligned pairs of wedge-bolt-receiving slots extending through the contiguous siderails, said siderails further having longitudinal ribs projecting outwardly and parallel to said facing from the extremity of said siderails most-removed from said facing, said ribs having notches in alignment with said pairs of wedge-bolt-receiving slots, the corresponding notches of contiguous siderails being disposed in registration with one another and defining voids in alignment with at least some of said pairs of wedge-bolt-receiving slots, a wedge bolt mounted in at least one of said pairs of wedge-bolt-receiving slots, an attachment in the form of a strong plate having two spaced holes with said first hole pivotally accommodating said wedge bolt and thereby securing said plate within one of said voids and with said plate having a second hole spaced from said first hole sufficiently to be capable of being positioned beyond said rails and being adapted to receive said hook element, and a second wedge bolt locking said first wedge bolt in place, whereby said attachment is pivotally secured in one of said voids by said first wedge bolt.

2. A device as claimed in claim 1; wherein said holes are circular.

3. A device as claimed in claim 1 where said first hole is circular.

4. A device as claimed in any one of claims 1 or 3, wherein the dimensions of said attachment along the axis between said holes of said attachment are not diminished from at least said second hole to and including the point for engagement by said member.

5. A device as claimed in any one of claims 1 or 3, wherein the spacing and physical dimensions and characteristics of said plate between said second hole and said member are selected so as to resist permanent bending or other failure due to forces exerted on said attachment at said second hole within predetermined standard safety limits.

6. A device as claimed in any one of claims 1, or 3, wherein said plate is made from flat metal.

7. A device as claimed in claim 6, wherein said attachment is generally in a shape approximating an ellipse with said holes being symmetrically spaced along its major axis near the ends thereof.

* * * * *